US005833080A

United States Patent [19]

Donne

[11] Patent Number: 5,833,080

[45] Date of Patent: Nov. 10, 1998

[54] ROTARY GOURMET PANHANDLER

[76] Inventor: Donald E. Donne, 4202 S. Carey St., Marion, Ind. 46953

[21] Appl. No.: 899,769

[22] Filed: Jul. 24, 1997

[51] Int. Cl.[6] ..... A47F 5/00

[52] U.S. Cl. ..... 211/85.31; 211/78; 211/181.1; 211/163; D6/458; 248/175

[58] Field of Search ..... 211/85.31, 181.1, 211/163, 78, 205, 70.7, 119, 71.01, 70, 41.11; D6/462, 486, 487, 449, 458; 248/131, 425, 175, 163.2

[56] References Cited

U.S. PATENT DOCUMENTS

| | | | |
|---|---|---|---|
| D. 206,699 | 1/1967 | Douglas | D6/458 |
| D. 250,686 | 1/1979 | Ashcraft | D6/458 |
| D. 298,193 | 10/1988 | Carlson | D6/462 |
| D. 351,959 | 11/1994 | Klein | D6/487 |
| D. 361,224 | 8/1995 | Stanley | D6/458 |
| 710,805 | 10/1902 | Riley | 211/181.1 X |
| 933,142 | 9/1909 | Vogt | 211/181.1 X |
| 3,780,875 | 12/1973 | Scholl | 211/163 X |
| 3,858,529 | 1/1975 | Salladay | 211/163 X |
| 5,094,352 | 3/1992 | Green et al. | 211/59.1 X |
| 5,765,700 | 6/1998 | Donne | 211/181.1 X |

*Primary Examiner*—Robert W. Gibson, Jr.
*Attorney, Agent, or Firm*—Daniel O'Connor

[57] ABSTRACT

A stand or rack specifically designed for the display of gourmet pots and pans. A table-top model and a floor model include inwardly extending arms and a ball-bearing assembly which allows the upper portion to be rotated for ease of use and display. The design also includes an upper ring structure which allows lids to be conveniently stored. The design may be readily manufactured for widespread commercial appeal.

7 Claims, 2 Drawing Sheets

ROTARY GOURMET PANHANDLER

This application is generally related to co-pending application Ser. No. 08/802,238, now U.S. Pat. No. 5,765,700.

BACKGROUND AND OBJECTS OF THE INVENTION

U.S. Pat. No. 5,094,352 illustrates the state of the prior art related to supporting devices for pots and pans and like articles.

The prior art designs have been effective for storage purposes but have not been widely marketed as effective display items for gourmet pots and pans.

Prior art designs have also proven to be relatively costly to manufacture and sell and have thus not found widespread acceptance in the art.

Prior art designs have also proven to be unstable and difficult to use in practice.

Accordingly, it is an object of the present invention to demonstrate a novel support for gourmet pots and pans which effectively and attractively displays such pots and pans.

It is a further object of the invention to show a novel support which may be economically manufactured for widespread commercial distribution.

It is a still further object of the invention to set forth a novel support design which is highly stable in use for enhanced safety for the consumer.

It is also an object of the invention to demonstrate a gourmet pot and pan support which is of highly durable construction for a longer use life by the consumer.

It is a further object to show a rotary pot and pan support which enhances ease of use and which also includes a means to conveniently store and display the lids for such articles.

These and other objects and advantages of the present invention will be appreciated by those of skill in the support and display arts.

SUMMARY OF THE INVENTION

One design is 4–5' tall floor-standing structure which is fabricated of metal or other high-durability materials.

A widened base provides for unit stability while a narrower middle portion enables the pots and pans to be fully displayed without using excess space.

The see-through design allows the gourmet pots and pans to be effectively displayed and results in lower manufacturing costs by using fewer component parts.

A related design, which utilizes similar components and features, comprises a 2–3' tall table-top model.

Both designs include a ball-bearing assembly which allows the upper portions to be rotated by the user for enhanced use and display.

The designs also include a lid supporting ring for increased storage capability and display.

DESCRIPTION OF THE DRAWING FIGURES

DESCRIPTION OF THE PREFERRED EMBODIMENTS

Figure 1:
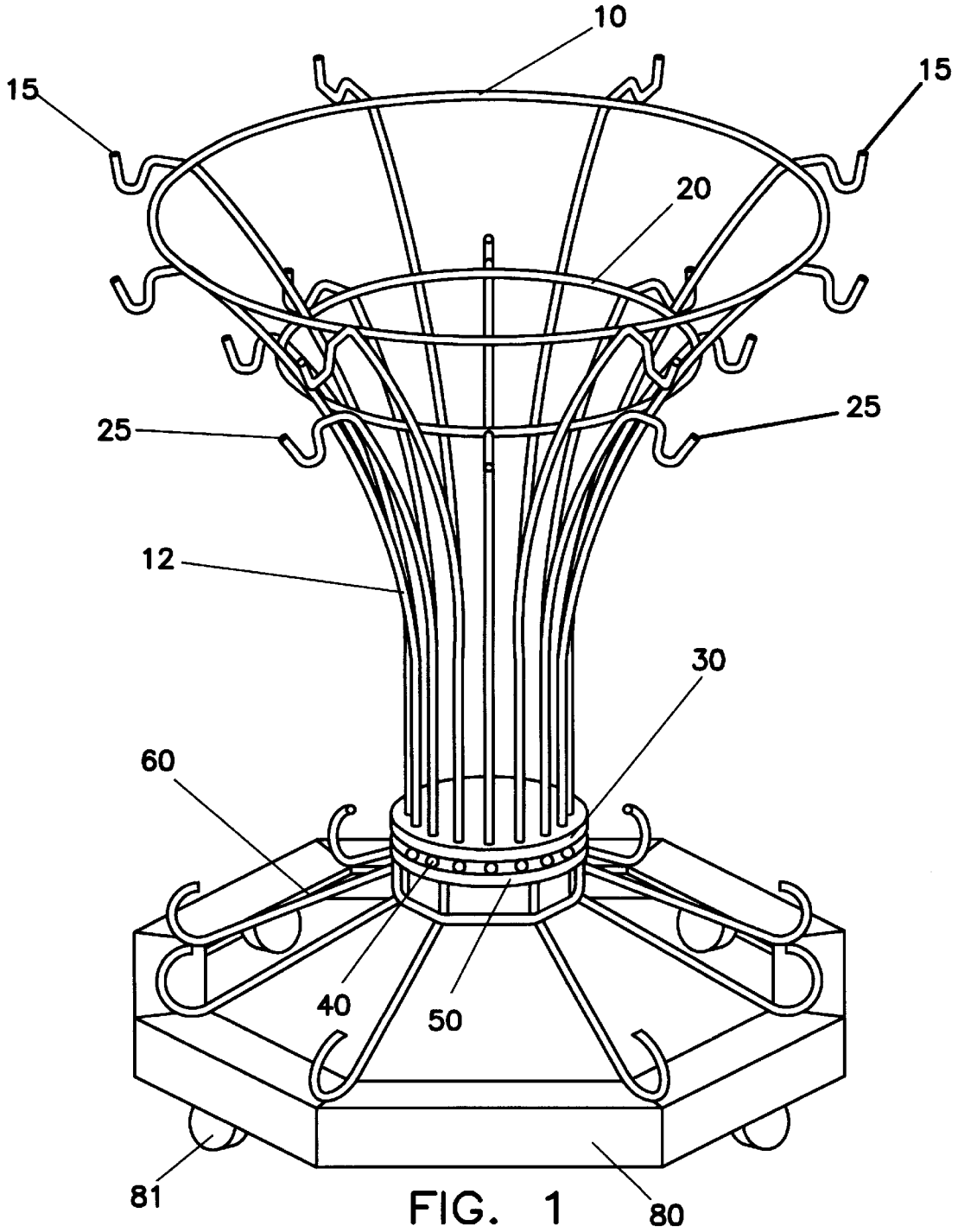
FIG. 1 is a side elevational view of the shorter table-top model designed to support gourmet pots and pans.

Referring to the drawing FIGS. 1 and 2, the elements in common between the table-top model and the floor model are described as follows.

Each unit has an upper ring element 10 with legs 12 extending down and inwardly therefrom. Ring element 10 has pot and pan hooks 15 around the periphery thereof.

A second lower ring 20 is also attached inwardly of the legs 12 and serves as a support for pot and pan lids when the unit is in use. The lower ring 20 also has hooks 25 mounted around the periphery thereof.

As further shown, the legs 12 extend downward and inward to a circular base plate 30 to which the legs 12 are welded or otherwise attached.

A ball-bearing plate 40 is positioned between member 30 and a lower circular base plate 50. Such ball-bearing plate enables the upper part of the units to be turned for efficient display and access.

Legs 60 extend outwardly from the base plate 50 to an octagonal support base 80.

It will thus be appreciated that the overall shape of both units is that of an hourglass which gives stability while providing efficient storage and display space for pots and pans when the units are in use.

Figure 2:
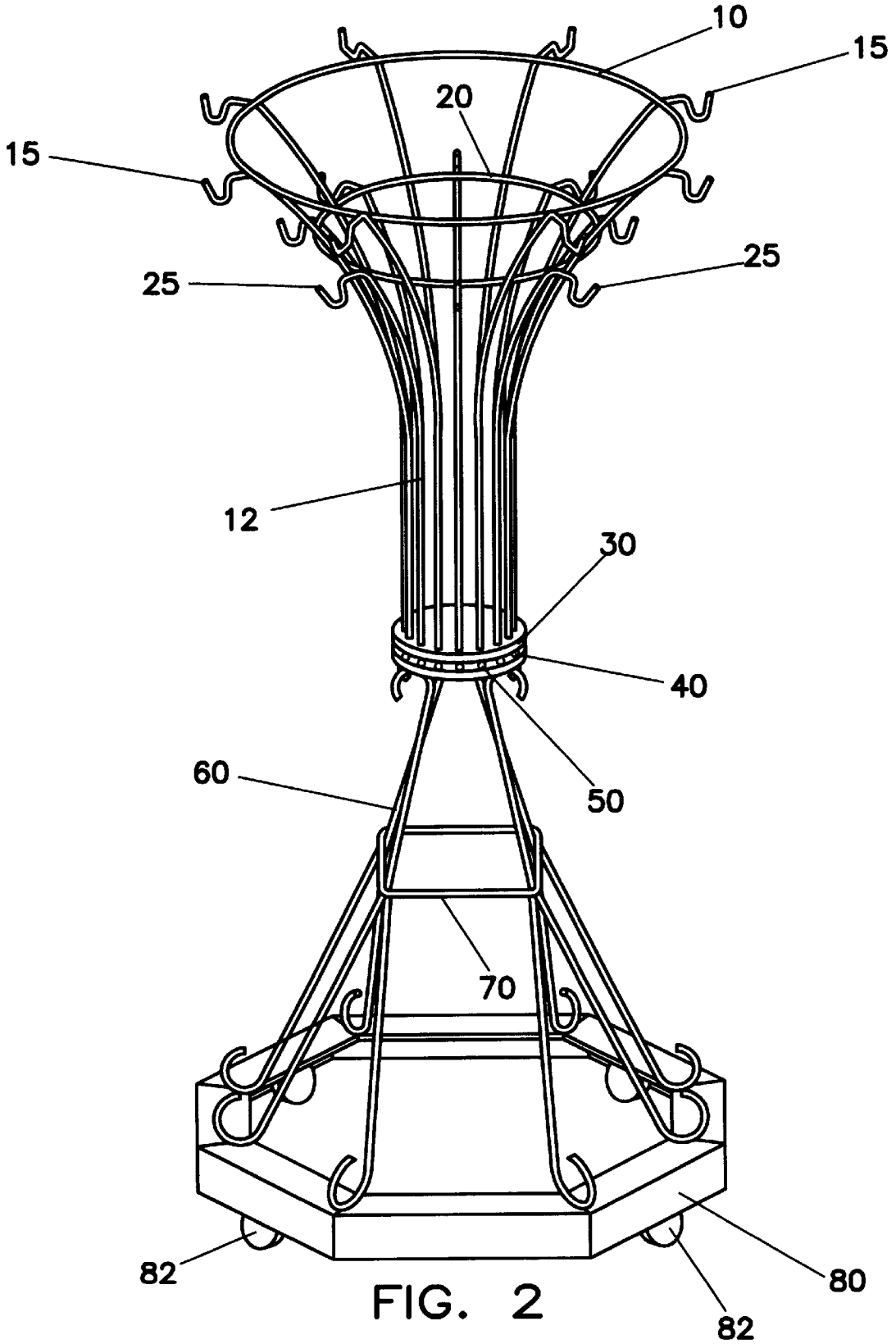
FIG. 2 is a side elevational view of the taller floor model of the invention.

The table-top unit of FIG. 1 has soft feet elements 81 attached thereto while the floor model of FIG. 2 has plural rollers 82 attached thereto for ease of movement of the larger floor model.

Both units may have horizontal support struts 70 on the lower portion to add further stability to the overall design. FIG. 2 shows such struts 70.

It will thus be appreciated that a see-through design is created wherein a large number of gourmet pots and pans may be attractively displayed and stored. The ring elements 20 also provide a supporting space for lids to be stored.

The units may be relatively easily manufactured using known metals and welding or other attaching techniques known in the mechanical assembly arts. The units may thus be economically manufactured for widespread commercial appeal.

The design is highly stable by reason of the widened support base 80 which render the units nearly impossible to tip over.

The units effectively save space while attractively displaying gourmet pots and pans and the lids therefor.

While particular embodiments have been described, it is intended to cover all equivalent structures which would reasonably occur to those of skill in the art.

I claim:

1. A support rack means for holding gourmet pots, pans and lids comprising:

an upper ring element(10) having plural legs(12) extending downwardly and inwardly therefrom, a plurality of hook means(15) around the periphery of said upper ring element, said legs(12) extending to a circular base plate(30), ball-bearing means(40) between said circular base plate(30) and a lower circular base plate(50), legs(60) extending downwardly from said lower circular base plate to a support base(80).

2. The support rack means of claim 1 and further including lower ring means(20) inward of legs(12) to provide a supporting space for lids.

3. The support rack means of claim 2 wherein said lower ring means(20) has a plurality of hooks(25) around the periphery thereof.

4. The support rack means of claim 3 wherein said support base(80) is octagonal in shape to provide stability to the overall unit.

5. The support rack means of claim 4 wherein the overall unit shape is that of an hourglass to give stability to the structure.

6. The support rack means of claim 5 wherein said circular base plates(30,50) are of smaller diameter than said upper ring element(10) and said support base(80).

7. The support rack means of claim 6 wherein the upper portion of said rack is rotatable via said ball-bearing elements(40).

* * * * *